US008142038B2

(12) United States Patent
Li et al.

(10) Patent No.: US 8,142,038 B2
(45) Date of Patent: Mar. 27, 2012

(54) REFRIGERATOR

(75) Inventors: Biao Li, Shandong (CN); Jingchun Wang, Shandong (CN); Kailong Ren, Shandong (CN); Fumin Wu, Shandong (CN); Wen Zhang, Shandong (CN)

(73) Assignees: Haier Group Corporation, Shandong (CN); Quingdao Haier Special Freezer Co., Ltd., Shandong (CN)

( * ) Notice: Subject to any disclaimer, the term of this patent is extended or adjusted under 35 U.S.C. 154(b) by 319 days.

(21) Appl. No.: 12/489,111

(22) Filed: Jun. 22, 2009

(65) Prior Publication Data

US 2010/0061079 A1 Mar. 11, 2010

(51) Int. Cl.
*F25D 27/00* (2006.01)

(52) U.S. Cl. ..... 362/92; 362/94; 362/125; 362/126; 362/154; 362/155

(58) Field of Classification Search ..... 362/92, 362/94, 125, 126, 154, 155, 267, 396
See application file for complete search history.

(56) References Cited

U.S. PATENT DOCUMENTS

| | | | | |
|---|---|---|---|---|
| 5,937,666 | A * | 8/1999 | Trulaske, Sr. | 62/264 |
| 6,406,108 | B1 * | 6/2002 | Upton et al. | 312/116 |
| 7,320,528 | B2 * | 1/2008 | Gotz | 362/94 |
| 2009/0244884 | A1 * | 10/2009 | Trulaske, Sr. | 362/94 |

* cited by examiner

*Primary Examiner* — Stephen F Husar
*Assistant Examiner* — James Cranson, Jr.
(74) *Attorney, Agent, or Firm* — Scully, Scott, Murphy & Presser, P.C.

(57) ABSTRACT

A refrigerator has a door, a lampshade and a lamp set, internal and external clamping walls and a seal retainer formed on the frame of the door. The lampshade and the lamp are set on the inner side of the frame of the door. The lamp is installed on the inner side of the doorframe, so that on the one hand the inner space of the refrigerator is not occupied by the illuminating device, and on the other hand, damage to the lamp caused by placing or taking goods relative to the refrigerator is prevented. Also, the lamp is installed on the door, and the light generated by the lamp irradiates inwardly to enhance the illuminating effect.

9 Claims, 3 Drawing Sheets

REFRIGERATOR

CROSS REFERENCE TO RELATED APPLICATION

The present application claims the benefit of the Chinese Application No. 200820188215.0 filed on Sep. 10, 2008, the entire contents of which are incorporated herein by reference.

BACKGROUND OF THE INVENTION

1. Field of the Invention

The present invention relates to a refrigerator, and in particular relates to a commercial refrigerator with LED lights for illumination.

2. Discussion of the Related Art

At present, illuminating tools used by conventional commercial refrigerators are ordinary fluorescent lamps, which consist of ballasts, bulbs, lamp holders, connecting wires and strip lamps. During the application, there are problems in that the fluorescent lamps suffers the disadvantages of short service life, large power consumption, attenuation of light at low temperature and being non-environmental.

To eliminate the disadvantages of conventional commercial refrigerators using fluorescent lamps, Chinese invention patent ZL 200620167055.2 discloses a commercial refrigerator using LED light for illuminating, which comprises case body, power unit, refrigeration system, external and internal lamp boxes of commercial refrigerator, and the technical feature of which is replacing the fluorescent lamps with strip LED lights in the lamp boxes of commercial refrigerator. Usually, protective covers are provided on the LED lamps to prevent the lamps from being damaged by goods coming in and out the refrigerator. However, the volume of the refrigerator inner liner has been relatively reduced, since the whole illuminating device arranged on the side wall of the inner liner has taken up part of the space for storage. Moreover, most of the lampshades of conventional commercial refrigerators are formed by transparent material, as a result, the lamp light not only irradiates into the refrigerator but also into people's eyes, causing visual influence and discomfort to users.

It is an object of the present invention to solve the technical problems mentioned above.

SUMMARY OF THE INVENTION

The present invention provides a refrigerator to resolve the technical problem existed in prior art, i.e. the illuminating device for commercial refrigerator is arranged on the side wall of the inner liner, causing the reduction of the space for storage.

The following technical solutions are provided by the present invention to solve the above mentioned technical problems.

A refrigerator, comprising at least a door, a lampshade and a lamp, internal and external clamping walls and a seal retainer are provided on the frame of the door, wherein the lampshade and the lamp are set on the inner side of the frame of the door.

The present invention further comprises the technical feature that, a nontransparent shading part, which prevents the light of the lamp from irradiating outside the door, is provided on the lampshade or the frame of the door.

The present invention further comprises the technical feature that, the lampshade is clipped on the frame.

The present invention further comprises the technical feature that, a fixation slot forming by two protrusions is set on the frame between the seal retainer and the internal clamping wall, the lamp is a LED lamp which is installed on a lamp board which is fixed to the fixation slot by a screw.

The present invention further comprises the technical feature that, the lamp is a LED lamp which is installed on one of the side of a "V" shape lamp board, the other side board of the lamp prevents the light of the lamp from coming out of the door glass directly, the "V" shape lamp board is a nontransparent board or a reflective board.

The present invention further comprises the technical feature that, a positioning slot and a stopper are arranged on the edge of the frame, a positioning insert corresponding to the positioning slot and a positioning clip corresponding to the stopper as well as a poke for easy replacement are arranged on the lampshade.

The present invention further comprises the technical feature that, the cross section of the body of the lampshade is substantially L shape, and the positioning insert is located at one end of the body of the lampshade, the positioning clip and the poke, together of which form a "V" shape, are located at the other end of the lampshade.

The present invention further comprises the technical feature that, the lampshade is formed by compressing transparent material together with nontransparent material, wherein the nontransparent shading part is near and basically perpendicular to the glass, and the rest part of the lampshade is the transparent part.

The present invention further comprises the technical feature that, the positioning slot is positioned at the top of the internal clamping wall, and the opening of which is parallel to the surface of glass, the stopper is formed by extending an end of the seal retainer which is near to the fixation slot.

The present invention further comprises the technical feature that, a left panel is set on the internal clamping wall on the side near to the fixation slot, and a right panel is set on the stopper on the side near to the fixation slot, the both ends of the lamp board are respectively supported by the left panel and right panel.

Comparing to the prior art, the advantages and effects of the present invention are as follows:

1. In the present invention, the lamp is installed on the inner side of the door frame, so that on the one hand the inner space of the refrigerator is not occupied by the illuminating device any more; on the other hand, the damage of the lamp caused by the operation of putting goods in and getting goods out of the refrigerator is therefore prevented, furthermore, the lamp is installed on the door, and its light irradiates inward, bringing on a better display effect.
2. The lampshade comprises a nontransparent shading part. When the lampshade is installed on the frame, the nontransparent shading part blocks the light coming out of the glass, and thus effectively prevents the eyes of the users from being irradiated by the light.
3. The lampshade is mounted on the inner side of the door frame by means of a simple structured clip device, so that the matching structure of the lampshade and the frame is simple, and the lampshade can be easily and quickly installed or uninstalled without using specific tools.
4. The lamp board is fixed to the fixation slot by a screw 5, and the fixation slot is formed by two protrusions on the door frame and serves as a screw hole, so that it is unnecessary to set a screw hole, and this kind of fixation slot fits for lamp boards of any length.

5. The lamp shade is formed by compressing transparent material together with nontransparent material, also it is simple structured and can be easily manufactured.

The present invention is simple and novel in structure and convenient in manufacture process, and can be widely applied to commercial refrigerators.

Figure 1:
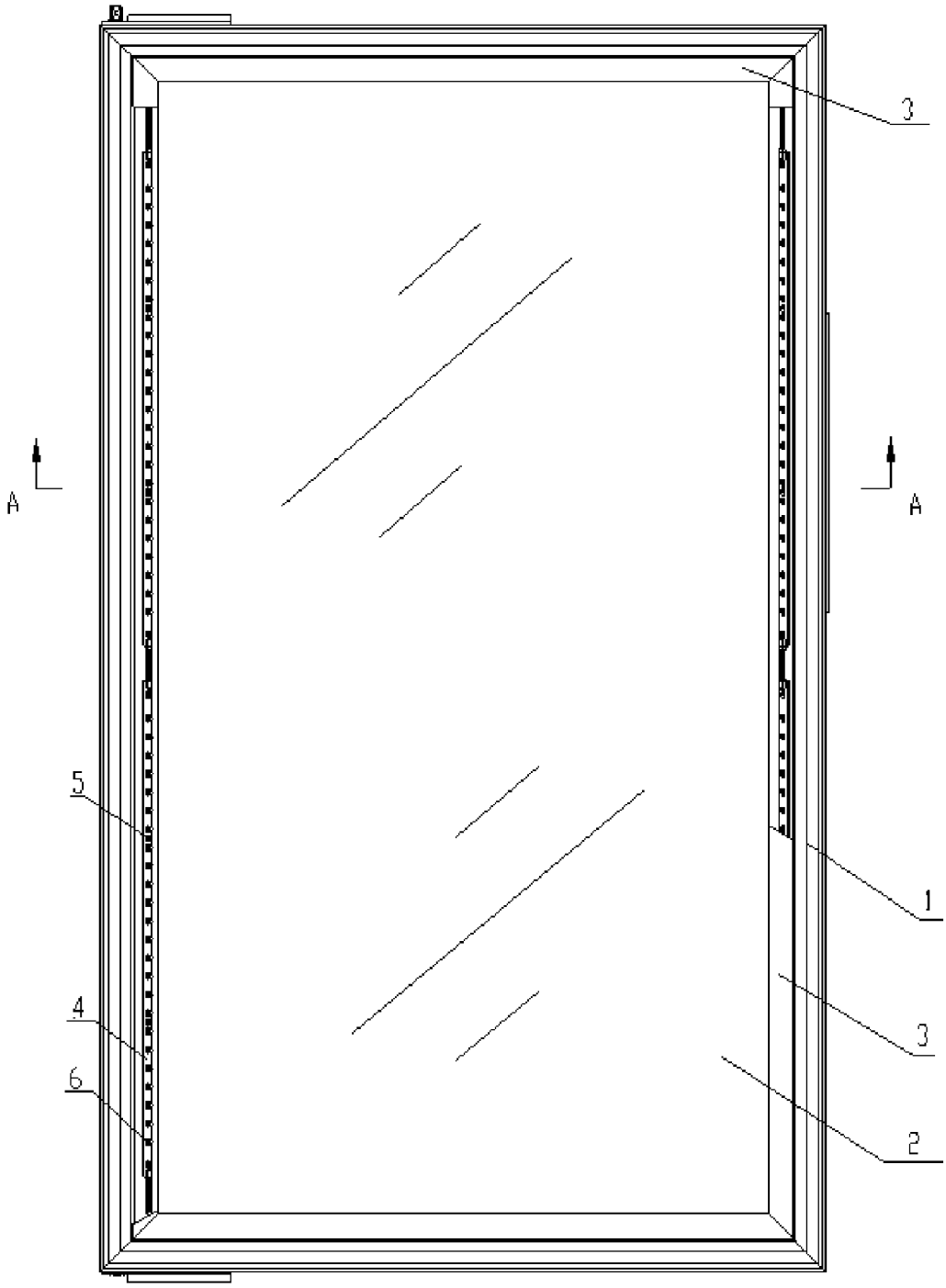
FIG. 1 shows a schematic view of the glass door of the refrigerator according to the present invention.
Figure 2:
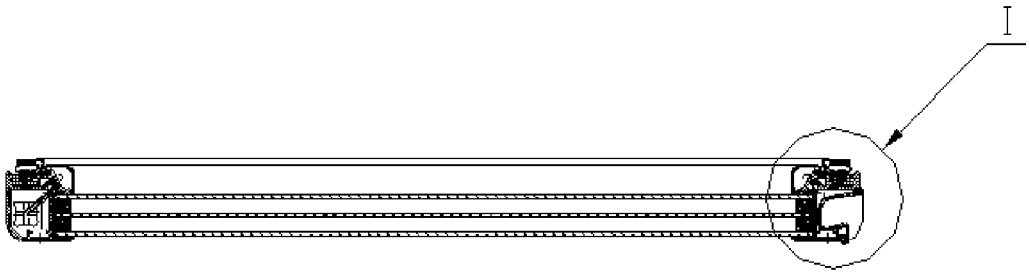
FIG. 2 shows a cross section view taken along line A-A in FIG. 1.

Reference numerals: 1 frame; 1-1 external clamping wall; 1-2 internal clamping wall; 1-2-1 positioning slot; 1-2-2 left panel; 1-3 protrusion; 1-4 fixation slot; 1-5 stopper; 1-5-1 right panel; 1-5-2 groove; 2 glass; 3 lampshade; 3-1 nontransparent part; 3-2 transparent part; 3-3 positioning insert; 3-4 positioning clip; 3-5 poke; 4 lamp board; 5 screw; 6 LED lamp; 7 seal retainer.

DETAILED DESCRIPTION OF THE INVENTION

Embodiments of the present invention will be explained in detail below with reference to the drawings.

In the first embodiment, as showed in FIGS. 1-4, a glass 2, an external clamping wall 1-1 and an internal clamping wall 1-2, and a seal retainer 7 are provided on the door frame 1, the glass 2 is located between the external clamping wall 1-1 and the internal clamping wall 1-2 of the door frame 1. A LED lamp 6 is installed on the lamp board 4, which is a nontransparent plate or reflector and is arranged on the inner side of the door frame 1. A lampshade 3 is clipped on the frame 1, and an engaging mechanism is provided on the joint of the lampshade 3 and the frame 1.

Figure 3:
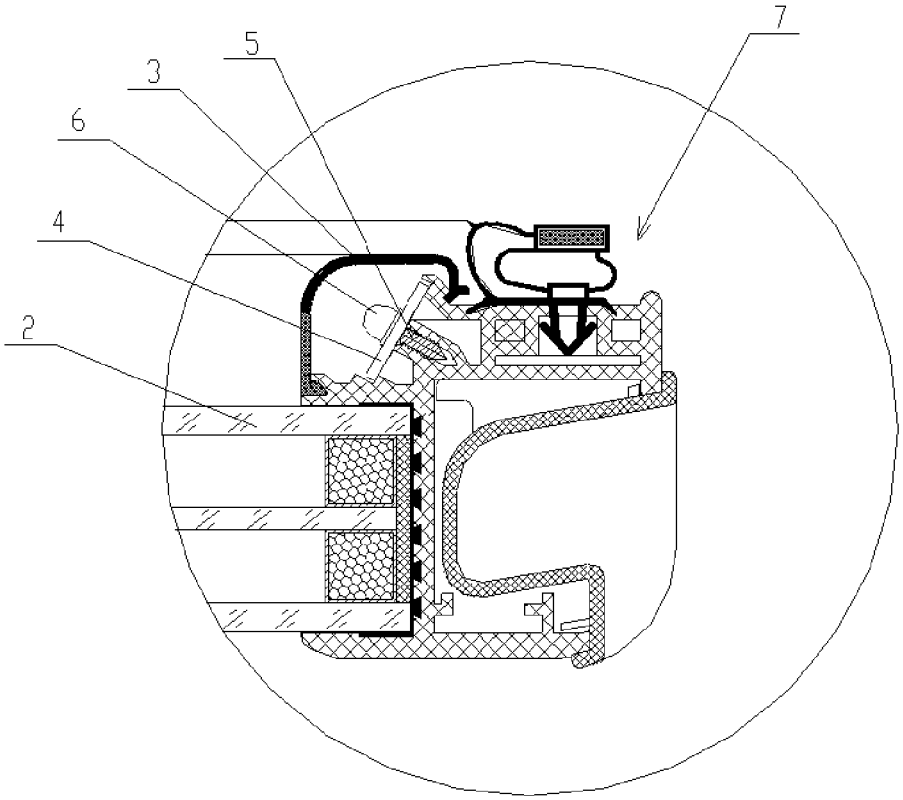
FIG. 3 shows an enlarged view of part I in FIG. 2.
Figure 4:
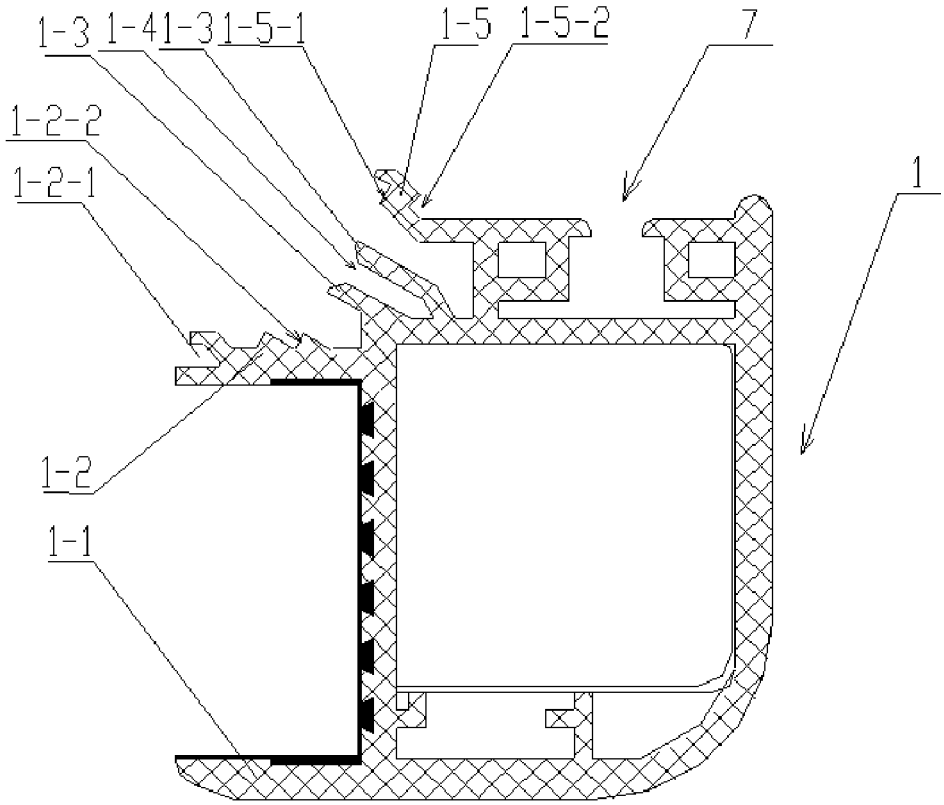
FIG. 4 shows a cross section view of the door frame.
Figure 5:
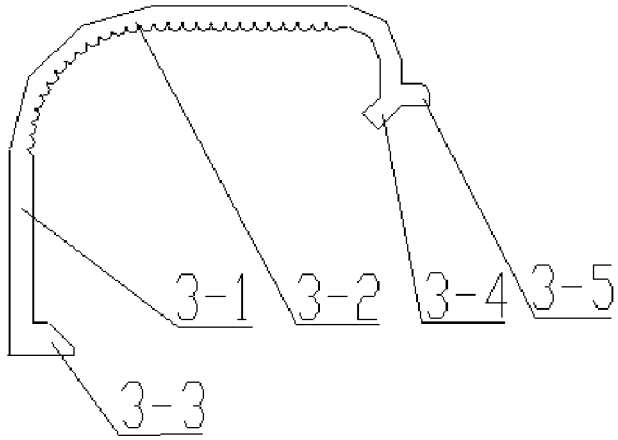
FIG. 5 shows a schematic view of the lampshade.

As shown in FIGS. 3-5, the engaging mechanism according to the present embodiment comprises a positioning slot 1-2-1 and a stopper 1-5, both of which are formed on the frame 1, and also a positioning insert 3-3 corresponding to the positioning slot 1-2-1 and a positioning clip 3-4 corresponding to the stopper 1-5 as well as a poke 3-5 for easy replacement of the lampshade, all of which are formed on the lampshade 3. This engaging mechanism is simple and compact in its structure. When installing, first inserting the positioning insert 3-3 on the lampshade 3 into the positioning slot 1-2-1 on the frame 1, and then clipping the flexible positioning clip 3-4 on the lampshade 3 to the groove 1-5-2 of the stopper 1-5; When disassembling, the positioning clip 3-4 can be easily detached from the groove 1-5-2 of the stopper 1-5 by operating the poke 3-5.

The lampshade 3 comprises a nontransparent shading part 3-1. When the lampshade 3 is installed on the frame 1, the nontransparent shading part blocks the light coming out of the glass 2, and thus effectively prevents the eyes of the users from being irradiated by the light. The cross section of the body of the lampshade 3 is substantially L shape, and according to the present embodiment it is rectangular shape. The positioning insert 3-3 is located at one end of the body of the lampshade 3, and the positioning clip 3-4 as well as the poke 3-5, together of which form an approximate "V" shape, are located at the other end of the lampshade 3. Being mounted onto the frame 1, the part which is near to the glass 2 and perpendicular to the same is the nontransparent part 3-1, and the rest part of the lampshade 3 is the transparent part 3-2.

The positioning slot 1-2-1 is positioned at the top of the internal clamping wall 1-2, and the opening of which is parallel to the surface of glass 2. The stopper 1-5 is formed by extending an end of the seal retainer 7 which is nearer to the fixation slot 1-4, and the fixation slot 1-4 is positioned between the positioning slot 1-2-1 and the stopper 1-5, in the present embodiment, the fixation slot 1-4 is formed by two parallel protrusions 1-3 which are provided on the bottom surface of the seal retainer 7. A left panel 1-2-2 is set on the internal clamping wall 1-2 of the frame 1 on the side near to the fixation slot 1-4, and also a right panel 1-5-1 is set on the stopper 1-5 on the side near to the fixation slot 1-4. The lamp board 4 is fixed to the fixation slot 1-4 which serves as a screw hole by screw 5, so that it is unnecessary to set a screw hole. The both ends of the lamp board 4 are steadily supported by the left panel 1-2-2 and right panel 1-5-1. The lamp board 4 is inclined with respect to the glass 2 at a certain angle, i.e. the LED lamp set on the lamp board 4 faces the corner of the lampshade 3.

The lampshade 3 of the present embodiment is formed by compressing transparent material together with nontransparent material, wherein the nontransparent shading part is near to the glass 2, and the rest part of the lampshade is the transparent part. Of course, the nontransparent part of lampshade 3 can also be formed by pasting nontransparent layer or applying nontransparent material to the lampshade 3.

The engaging mechanism can also be other kinds of buckle structures, for example, two clips are provided at both ends of the lampshade 3, corresponding to which two slots are set on the frame 1. The lampshade 3 is clipped on the frame 1 by the elastic deformation force.

The second embodiment of the present invention differs from the first embodiment in the fact that, a nontransparent part is provided on the frame 1 to prevent the light of the lamp from coming out of the door glass 2 directly, i.e. the door frame 1 comprises a nontransparent part which blocks the light coming out of the glass 2. The nontransparent part is basically perpendicular to the surface of the glass, so that it can effectively deflect the lamp light. Moreover, the purpose of the present invention can also be achieved by reforming the lamp board 4, i.e. forming the lamp board 4 into a "V" shape, and the LED lamp 6 is installed on one of the side of the "V" shape lamp board 4, the other side of the lamp board 4 serves as the nontransparent part, preventing the light of the lamp from coming out of the door glass 2 directly. The present embodiment is simple in structure, thus the detailed structure and the cooperative relationship of which are not shown by drawings.

The present invention is not limited to the above embodiment and modifications, but may be variously embodied within the scope of the invention.

What is claimed is:

1. A refrigerator, comprising at least a door;

a lampshade and a lamp, provided on inner side of frame of the door;

internal and external clamping walls and a seal retainer, provided on the frame of the door; and a nontransparent shading part provided on the lampshade or the frame of the door, the nontransparent shading part being configured to prevent the light of the lamp from irradiating outside of the door.

2. The refrigerator according to claim 1, wherein the lampshade is clipped on the frame.

3. The refrigerator according to claim 2, further comprising a fixation slot formed by two protrusions set on the frame, which is between the seal retainer and the internal clamping wall, and wherein the lamp comprises a LED lamp which is installed on a lamp board fixed to the fixation slot by a screw.

4. The refrigerator according to claim 3, further comprising a positioning slot and a stopper arranged on the edge of the frame, and further comprising a positioning insert corresponding to the positioning slot, a positioning clip corresponding to the stopper, and a poke arranged on the lampshade for easy replacement of the lampshade.

5. The refrigerator according to claim 4, wherein the lampshade comprises a substantially L shaped cross section along the body thereof, and the positioning insert is located at one end of the body of the lampshade, and the positioning clip and the poke, which together form a "V" shape, are located at the other end of the lampshade.

6. The refrigerator according to claim 4, wherein the positioning slot is positioned at the top of the internal clamping wall, the opening of which is parallel to the surface of glass, and the stopper is formed by extending an end of the seal retainer which is adjacent the fixation slot.

7. The refrigerator according to claim 6, further comprising a left panel set on the internal clamping wall on the side adjacent the fixation slot, and a right panel set on the stopper on the side adjacent the fixation slot, both ends of the lamp board respectively supported by the left panel and right panel.

8. The refrigerator according to claim 1, wherein the lamp board comprises a "V" shape lamp board, and the lamp comprises a LED lamp installed on one the side of the "V" shape lamp board, the other side of the lamp board preventing the light of the lamp from coming out of the door glass directly, the "V" shape lamp board being a nontransparent board or a reflective board.

9. The refrigerator according to claim 1, wherein the lampshade is formed by compressing transparent material together with nontransparent material, wherein the nontransparent shading part is near and basically perpendicular to the glass and the rest part of the lampshade is transparent.

* * * * *